US007841469B2

(12) United States Patent
Muyskens

(10) Patent No.: US 7,841,469 B2
(45) Date of Patent: Nov. 30, 2010

(54) CORNER POST FOR USE WITH AN ARTICLE HAVING A CONTOURED VERTICAL EDGE

(75) Inventor: David B Muyskens, Hendersonville, TN (US)

(73) Assignee: Sonoco Development, Inc., Hartsville, SC (US)

( * ) Notice: Subject to any disclaimer, the term of this patent is extended or adjusted under 35 U.S.C. 154(b) by 64 days.

(21) Appl. No.: 12/446,602

(22) PCT Filed: Jan. 30, 2008

(86) PCT No.: PCT/US2008/052404

§ 371 (c)(1),
(2), (4) Date: Apr. 22, 2009

(87) PCT Pub. No.: WO2008/094967

PCT Pub. Date: Aug. 7, 2008

(65) Prior Publication Data

US 2010/0000906 A1 Jan. 7, 2010

Related U.S. Application Data

(60) Provisional application No. 60/887,430, filed on Jan. 31, 2007.

(51) Int. Cl.
*B65D 81/02* (2006.01)
*B65D 85/30* (2006.01)

(52) U.S. Cl. ..... 206/453; 206/586

(58) Field of Classification Search ..... 206/453, 206/586; 248/345.1
See application file for complete search history.

(56) References Cited

U.S. PATENT DOCUMENTS

| | | | | |
|---|---|---|---|---|
| 2,858,037 | A | 6/1955 | Rose | |
| 5,267,651 | A | 12/1993 | Hughes | |
| 5,593,039 | A | 1/1997 | Ortlieb | |
| 6,059,104 | A | 5/2000 | Widman | |
| 6,234,314 | B1 | 5/2001 | Qiu | |
| 6,247,596 | B1 | 6/2001 | Muyskens | |
| 6,595,367 | B2 | 7/2003 | Baechle | |
| 6,881,469 | B2 * | 4/2005 | Hightower | 428/99 |
| 7,159,345 | B2 * | 1/2007 | Hunt | 40/312 |
| 2002/0144923 | A1 * | 10/2002 | Baechle | 206/453 |

* cited by examiner

*Primary Examiner*—Jacob K Ackun, Jr.
(74) *Attorney, Agent, or Firm*—Miller Matthias & Hull

(57) ABSTRACT

A corner post (10) for protecting a packaged article (50) having a curved vertical edge is provided. The corner post (10) comprises an outer wall (12) having first and second substantially planar outer wall members (14, 16) joined at a right angle along an outer corner (18), and a curvilinear inner wall (20) that conforms to the shape of the vertical edge.

8 Claims, 1 Drawing Sheet

CORNER POST FOR USE WITH AN ARTICLE HAVING A CONTOURED VERTICAL EDGE

BACKGROUND

1. Field of the Invention

This patent relates to a tubular corner post of the type used to cushion and protect a packaged article such as a large household appliance. More particularly, this patent relates to a tubular corner post that conforms to the shape of a packaged article having a contoured (curved or irregular) vertical edge.

2. Description of the Related Art

Corner posts for protecting packaged appliances and similar goods typically are inserted between the corners of the appliance and the outer sleeve or box. For this reason conventional corner posts generally have an L-shaped cross sectional profile, an inner corner defining a right angle to conform to the shape of the appliance corner, and an outer corner defining a right angle to conform to the shape of the outer sleeve. Many examples of such corner posts are known in the art, including those disclosed in U.S. Pat. Nos. 3,536,245; 4,483,444; 4,771,893; 5,131,541 and 6,186,329.

While each of these corner posts is useful for its particular purpose, none is suited for those modern appliances that have a more rounded or contoured shape, including appliances having significantly curved vertical edges.

Thus it is an object of the present invention to provide a corner post that can be used with an article having a front curvature to provide both impact protection and stacking strength.

Another object of the invention is to provide a corner post that conforms to the shape of an article having a curved vertical edge.

Still another object of the invention is to provide a corner post having an inner corner defining a curve that conforms to the curved shape of the vertical edge of a packaged appliance or other article and an outer corner defining a right angle to conform to the shape of the outer sleeve.

Further and additional objects will appear from the detailed description, accompanying drawings, and appended claims.

SUMMARY OF THE INVENTION

The present invention is a new style of paper corner post for protecting a packaged article having a curved vertical edge. The corner post comprises an outer wall and an inner wall joined at their ends to define a hollow space therebetween. The post inner wall is curvilinear to fit against the curved vertical edge of the packaged article. The post outer wall has first and second substantially planar outer wall members that are joined at substantially a right angle to fit the interior corner of a package sleeve, such as would be found with a corrugated box.

The corner post has a first transverse end wall joining corresponding vertical edges of the outer and inner walls and a second transverse end wall joining the other corresponding vertical edges of the outer and inner walls. The first transverse end wall and the outer wall may form an obtuse angle, and the second end wall and the outer wall may form a right angle.

One or more beads may be integrally formed in the outer wall along at least part of its length for added strength. The bead extends toward the curved inner wall and terminates in an apex. The bead has two side walls. Preferably, one side wall forms an obtuse included angle with the outer wall and the other side wall forms an acute included angle with the outer wall so that, if the corner post is subjected to a lateral compressive force sufficient to cause it to deform, the bead will move into engagement with one of the end walls to resist further deformation. Preferably the bead side wall nearest that end wall is longer than the outer wall segment between the bead and that end wall.

Thus, at its essence, the invention may be thought of as an elongated corner post for protecting a packaged article having an irregular or curved shaped vertical edge, the corner post comprising an outer wall and an inner wall joined at opposing ends to define a hollow space (22) therebetween, wherein the outer wall has an outer corner shaped to match the right angle inner corner of a package sleeve and the inner wall is shaped to match the irregular or curved vertical edge of the packaged article. Preferably the corner post further comprises a bead to resist collapsing of the corner post during impact.

THE DRAWINGS

DETAILED DESCRIPTION OF THE INVENTION

Figure 1:
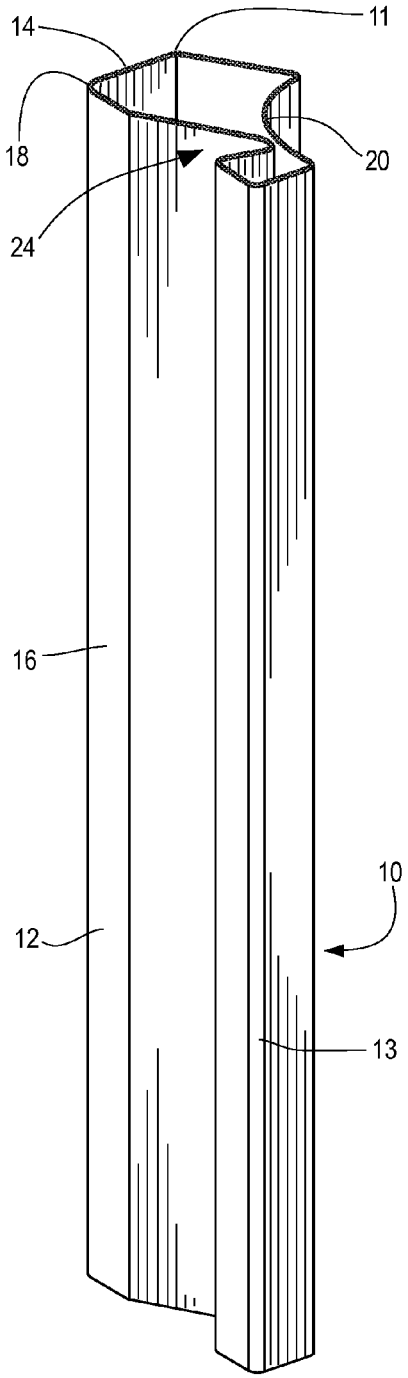
FIG. 1 is a perspective view of a corner post according to the present invention.

While this invention may be embodied in many forms, there is shown in the drawings and will herein be described in detail one or more embodiments with the understanding that this disclosure is to be considered an exemplification of the principles of the invention and is not intended to limit the invention to the illustrated embodiments.

Figure 2:
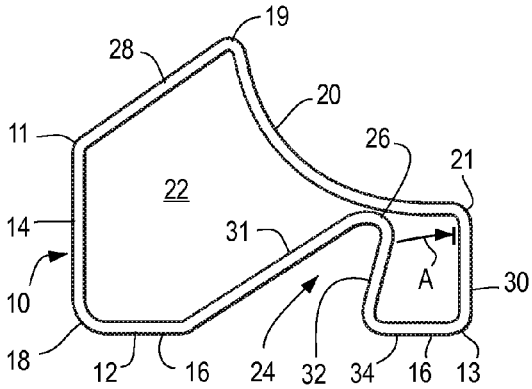
FIG. 2 is a top plan view of the corner post of FIG. 1.
Figure 3:
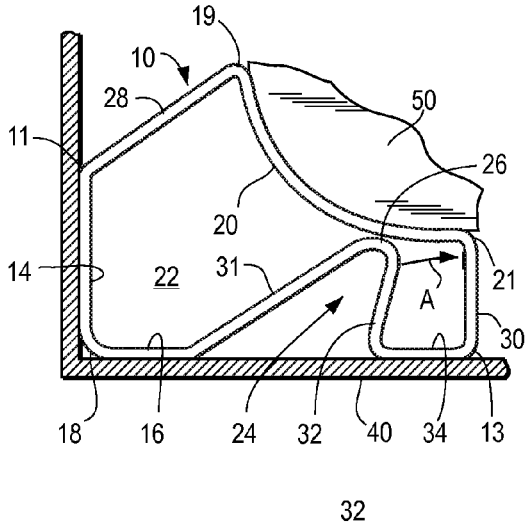
FIG. 3 is top plan view of the corner post of FIG. 1 shown installed between a washing machine and a packaging sleeve.

Turning to the drawings, there is shown in FIGS. 1-3 an elongated corner post 10 for protecting a packaged article 50 having one or more curved or irregular vertical edges. An irregular edge means an edge that is not a right angle, such as that found on many conventional household appliances. Preferably the corner post 10 is formed from convolutely wound paperboard. In the illustrated embodiment, the corner post 10 comprises an outer wall 12 and an inner wall 20 joined at opposing ends to define at least one hollow space 22 therebetween. The outer wall comprises first and second substantially planar outer wall members 14, 16 joined at a right angle along an outer corner 18 to conform to the rectilinear shape of the inside corner of a packaging sleeve 40. The outer wall members 14, 16 extend from the outer corner 18 and terminate in vertical edges 11, 13 respectively.

In a key aspect of the invention, the inner wall 20 is contoured to conform to the curvature of a vertical edge of the packaged article 50, which in this example is a washing machine. By "curved vertical edge" is meant a vertical edge that is curved in a horizontal plane. Thus, in FIG. 3 the inner wall 20 is contoured to conform to the curvilinear shape of the vertical edge of the washing machine 50. The inner wall 20 terminates in vertical edges 19, 21.

In the illustrated embodiment an inwardly directed bead 24 is integrally formed in and defined by the outer wall 12 along the (vertical) length of the outer wall 12. The bead 24 extends toward the inner wall 20, has two side walls 31, 32, and terminates in an apex 26. The apex 26 may or may not contact the inner wall 20 when the corner post 10 is in an unstressed (unflexed) condition.

The elongated corner post 10 further comprises a first transverse end wall 28 joining the corresponding vertical edges 11, 19 of the outer and inner walls, and a second transverse end wall 30 joining corresponding vertical edges 13, 21 of the outer and inner walls. In the illustrated embodiment, the first transverse end wall 28 and the first outer wall member 14 form an obtuse angle, although it should be understood that the first transverse member 28 and the first outer wall member 14 could also form an acute or right angle. The second end wall 30 and the second outer wall member 16 form a right angle, although it should be understood that they could form an acute or obtuse angle.

The corner post 10 is designed to flex (deform) when subjected to a lateral compressive force, as from a side impact, but the deformation will be limited by the post structure. Referring to FIGS. 2 and 3, when the corner post 10 is subjected to a lateral compressive force, the corner post bead 24 will move in the direction of arrow A. When the bead 24 contacts the end wall 30 the corner post will resist further flexing, thus maintaining the protective hollow space 22.

To aid in this deformation limiting function, the bead side wall 31 farthest from the end wall 30 should form an obtuse included angle with the outer wall 16, and the bead side wall 32 nearest the end wall 30 should form an acute included angle with the outer wall 16. In addition, the bead side wall 32 should be longer than the outer wall segment 34 between the bead 24 and the end wall 30. As a result of this configuration the bead 24 moves toward and the end wall 30 when the corner post 10 is compressed and will contact the end wall 30 if the side impact force is sufficiently great.

Thus there has been described a paperboard corner post 10 for use in the packaging of an article 50 having at least one rounded vertical edge. The corner post 10 has an outer wall 12 and an inner wall 20 joined at opposing ends to define a hollow space 22 therebetween. The inner wall 20 is contoured to conform to the curvature of the packaged article 50. The outer wall 12 has an outer corner formed by two substantially planar outer wall member 14, 16 joined at a right angle. The outer corner 18 conforms to the right angle shape of a packaging sleeve 40. An optional bead 24, integrally formed in the outer wall 12, extends toward the inner wall 20. The bead 24 is designed to move into engagement with an end wall 30 and/or the inner wall 20 to provide added impact resistance.

It is understood that the embodiments of the invention described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

I claim as my invention:

1. An elongated corner post (10) for protecting a packaged article (50) having a curved vertical edge, the corner post (10) comprising:

an outer wall (12) having first and second substantially planar outer wall members (14, 16) joined at a right angle along an outer corner (18) and terminating in first and second outer wall vertical edges (11, 13);

a first transverse end wall (28) extending from the first outer wall vertical edge (11) and terminating in a first inner wall vertical edge (19);

a second transverse end wall (30) extending from the second outer wall vertical edge (13) and terminating in a second inner wall vertical edge (21); and a curvilinear inner wall (20) extending from the first inner wall vertical edge (19) to the second inner wall vertical edge (21), the inner and outer walls being laterally spaced from one another and joined at opposing ends by the first and second transverse end walls (28, 30) to define at least one hollow space (22) therebetween, the inner wall (20) having an exterior side facing away from outer wall (12), wherein the exterior side is one continuous concave curved surface contoured to conform to the curved vertical edge of the packaged article (50).

2. The elongated corner post (10) of claim 1 further comprising:

a bead (24) integrally formed in the second substantially planar outer wall member (16) along at least part of the length of the outer wall (12) and extending toward the inner wall (20) and terminating in an apex (26).

3. The elongated corner post (10) of claim 2 wherein, if the corner post (10) is subjected to a lateral force of sufficient magnitude and is thereby deformed, the bead (24) will move into engagement with the second transverse end wall (30) to resist further deformation.

4. The elongated corner post (10) of claim 2 wherein the bead (24) comprises first and second side walls (31, 32), the first side wall (31) being further from the second transverse end wall (30) than is the second side wall (32), and wherein the first bead side wall (31) forms an obtuse included angle with the second substantially planar outer wall member (16), and the second bead side wall (32) forms an acute included angle with the substantially planar outer wall member (16).

5. The elongated corner post (10) of claim 4 wherein the second substantially planar outer wall member (16) comprises an outer wall segment (34) extending between the bead (24) and the second transverse end wall (30), and wherein the second bead side wall (32) is longer than the outer wall segment (34) between the bead (24) and the end wall (30).

6. The elongated corner post (10) of claim 1 wherein the first transverse end wall (28) and the first substantially planar outer wall member (14) form an obtuse angle, and the second end wall (30) and the second substantially planar outer wall member (16) form a right angle.

7. A combination article and packaging system comprising:

a packaged article (50) having at least one curved vertical edge;

a packaging sleeve (40) positioned around the packaged article (50) and having at least one inside corner defining a right angle and having a rectilinear shape; and a corner post (10) interposed between the packaged article (50) and the packaging sleeve (40), the corner post (10) comprising an outer wall (12) having first and second substantially planar outer wall members (14, 16) joined at a right angle along an outer corner (18) and terminating in first and second outer wall vertical edges (11, 13), the outer wall (12) being in substantially abutting relationship with the packaging sleeve, a first transverse end wall (28) extending from the first outer wall vertical edge (11) to a first inner wall vertical edge (19), a second transverse end wall (30) extending from the second outer wall vertical edge (13) to a second inner wall vertical edge (19), and an inner wall (20) laterally spaced from the outer wall and extending from the first inner wall vertical edge (19) to the second inner wall vertical edge (21), the inner wall (20) having an exterior side facing away from the outer wall (12) that is one continuous concave curved surface that completely conforms to the curved vertical edge of the packaged article.

8. The combination article and packaging system of claim 7 wherein the corner post (10) further comprises a bead (24) integrally formed in the second substantially planar outer wall member (16) and extending toward the inner wall (20) and terminating in an apex (26), and wherein, if the corner post (10) is subjected to a lateral force of sufficient magnitude and is thereby deformed, the bead (24) will move into engagement with the second transverse end wall (30) to resist further deformation.

* * * * *